United States Patent [19]

Bertrams

[11] Patent Number: 5,004,423

[45] Date of Patent: Apr. 2, 1991

[54] TRAINING AID FOR SUCH SIDE ARMS AS REVOLVERS AND PISTOLS

[76] Inventor: Kurt U. Bertrams, Benrather Strasse 1, D-41010, Düsseldorf, Fed. Rep. of Germany

[21] Appl. No.: 370,533

[22] Filed: Jun. 23, 1989

[30] Foreign Application Priority Data

Jun. 30, 1988 [DE] Fed. Rep. of Germany ..... 3822054

[51] Int. Cl.[5] ..... F41G 3/00

[52] U.S. Cl. ..... 434/22

[58] Field of Search ..... 434/22, 21; 273/312, 273/310, 311; 362/111

[56] References Cited

U.S. PATENT DOCUMENTS

| | | | |
|---|---|---|---|
| 4,083,560 | 4/1978 | Kikuchi et al. | 434/22 |
| 4,102,059 | 7/1978 | Kimble et al. | 434/22 |
| 4,352,665 | 10/1982 | Kimble et al. | 273/312 |

*Primary Examiner*—Richard J. Apley
*Assistant Examiner*—Glenn Richman
*Attorney, Agent, or Firm*—Sprung Horn Kramer & Woods

[57] ABSTRACT

A training aid (10) for such side arms as revolvers and pistols that comprises a transmitter (18) in the form of a replaceable cylinder (14, when the weapon is a revolver) or of a replaceable insert (114, when the weapon is a pistol or similar piece) and a receiver (16), whereby the transmitter has a release (22) that is activated by the impact of the weapon's hammer (20) and causes the transmitter to emit simultaneously with the impact a brief and narrowly collimated beam (24) of infrared light, the receiver is positioned at a desired distance away and produces a signal when it receives the beam, the beam of infrared light is generated by a diode (66) accomodated in a tube, and the release is at one end of the tube and a device (68, 70, or 168) that focuses the beam is at the other end. The tube is accommodated in or consists of a housing (48 or 148) that is externally shaped like a conventional cylinder or insert and has at least two adjacent cylindrical chambers (50 and 52 or 150 and 172) with their axes (56 and 58) paralleling that (62) of the weapon's barrel, whereby each chamber accommodates a tube (64), a diode, or a system of batteries (72 and 172) and is demarcated at one end by a plate (96 or 196) that is accommodated in another chamber (84 or 184) and has the electronic circuitry (FIG. 9) for the transmitter mounted on it and whereby the three chambers constitute mutually displaced spaces enclosed in one-piece housing (48 148).

20 Claims, 11 Drawing Sheets

RECEIVER (INFRARED AMPLIFIER)

Figure 11:
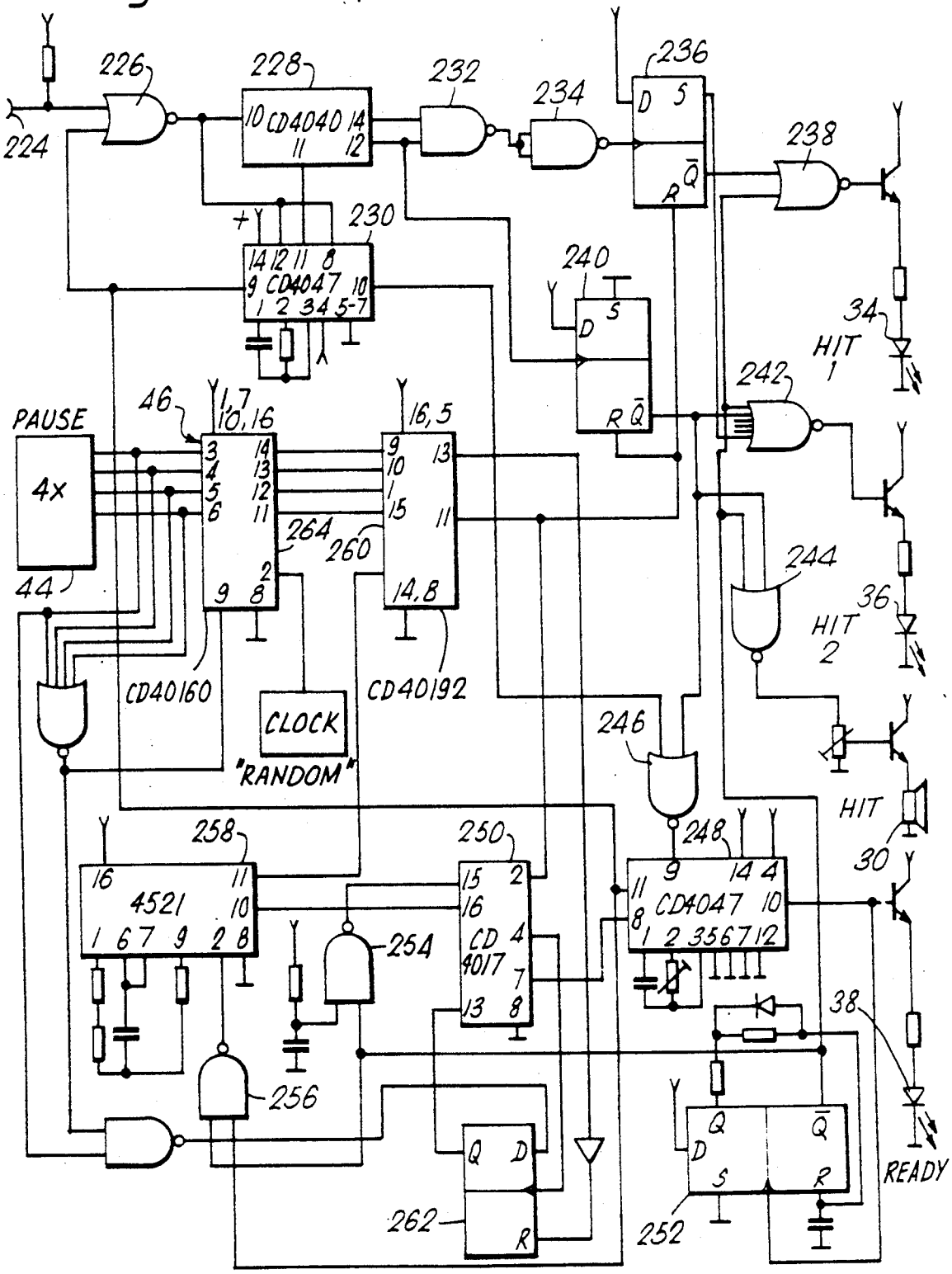

Fig. 11. RECEIVER (ELECTRONIC CONTROLS)

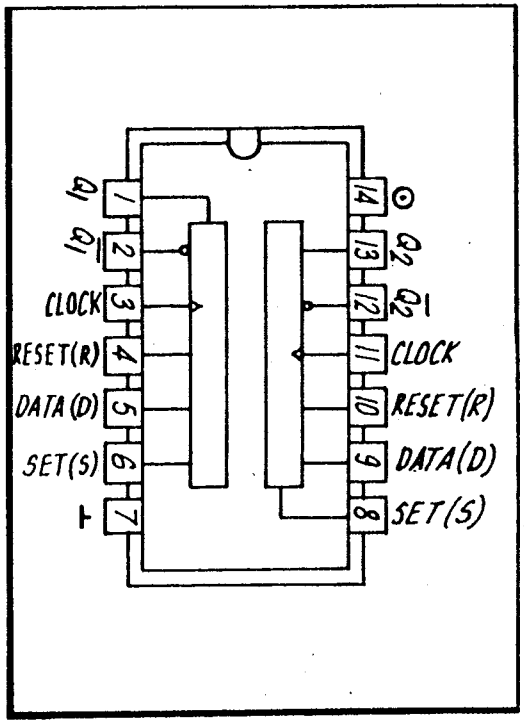
Fig.13a.
4013
Fig.13b.
4040
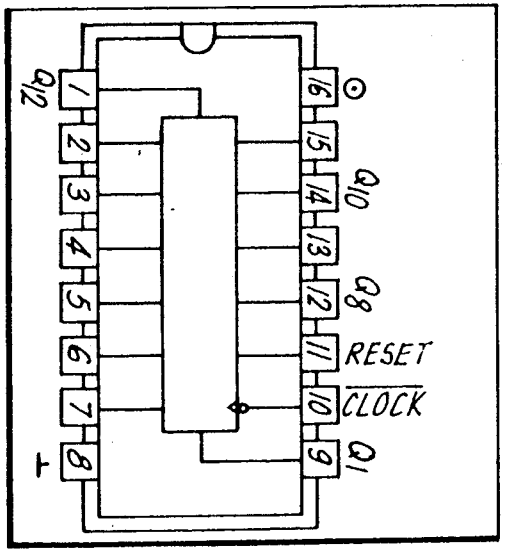
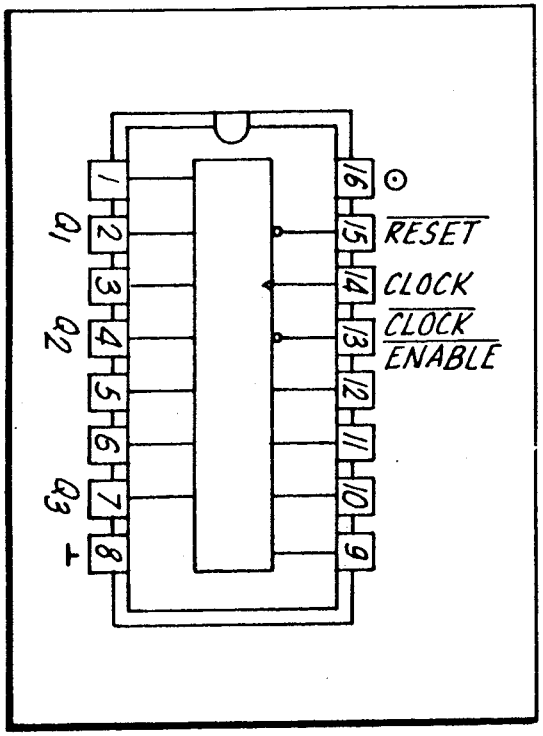
Fig.13c.
4017

4047

40192

40160

4521

TRAINING AID FOR SUCH SIDE ARMS AS REVOLVERS AND PISTOLS

FIELD OF TECHNOLOGY

The invention concerns a training aid for such side arms as revolvers and pistols that comprises a transmitter in the form of a replaceable cylinder (when the weapon is a revolver) or of a replaceable insert (when the weapon is a pistol or similar piece) and a receiver, whereby the transmitter has a release that is activated by the impact of the weapon's hammer and causes the transmitter to emit simultaneously with the impact a brief and narrowly collimated beam of infrared light, the receiver is positioned at a desired distance away and produces a signal when it receives the beam, the beam of infrared light is generated by a diode accommodated in a tube, and the release is at one end of the tube and a device that focuses the beam is at the other end.

STATE OF THE ART

A training device for shotguns and similar weapons is known from German Published Application OS 3 419 985 A1, which derives from the same applicant. A tube that has an electrical-contact generator instead of a percussion cap at one end and a source of light accompanied by a focusing device at the other end is inserted into the shotgun instead of a cartridge. When the contact generator is activated, a flash of light is emitted and strikes a target that immediately produces a "hit" signal. The flash of light can be coded with respect to brightness, plane of polarization, or hue. A beam of light that is modulated with respect to brightness in the visible or infrared range of the spectrum is in particular generated and is decoded in a receiver.

The receiver has a timer that establishes receiving and non-receiving intervals. It also has a timer with a randomness generator that establishes the lengths of the non-receiving intervals (periods between the intervals when the receiver is ready to receive). The flash of light in this known training aid is generated in the transmitter by a light-emitting diode associated with a lens. The diode is activated by a multivibrator in the form of an integrated circuit that is in turn activated for a specific length of time by the contact generator.

If the shot-gun is double-barreled, a tube with a flash-generating device is inserted instead of a cartridge in each barrel. Each device emits a differently coded beam, and the receiver has a separate channel for receiving each code, so that it can produce a different signal for each round fired in order to indicate whether the first or the second round strikes the target.

Thus, although the aforesaid publication discloses essential aspects of training aids for small arms, it entails the drawback that the known aids cannot be employed as is for such side arms as revolvers or pistols. Revolvers and pistols for instance have smaller bores than shotguns and cannot accommodate all of the components that are needed for the known training aid to operate. Furthermore, side arms require a larger set of tubes for practical application, six to occupy all the spaces in a revolver's cylinder and as many as a pistol's insert can hold.

A training aid for revolvers is known from the periodical *Moderne Waffentechnik*. The conventional cylinder is replaced by a cylinder that contains a flash generator with batteries for an oblong optical device that can be inserted into the barrel.

The receiver is simply a projection screen, and there are no electronic controls.

The potential for training with the latter system is relatively limited, and the former system disclosed in the German published application is not appropriate for side arms.

DESCRIPTION OF THE INVENTION

The main object of the invention is to improve the training aid known from the aforesaid published application to the extent that it can be employed with only one light generator and its associated electronic controls in such side arms as revolvers and pistols to simulate rapid firing (e.g. a sequence of six rounds in the case of a revolver). An ancillary object of the invention is to simulate as persuasively as possible certain mechanical properties of the weapon, making the mock cylinder as heavy as a real cylinder to maintain the feel of a revolver for example. Furthermore the training aid is to be designed to adapt to a wide range of small arms with relatively little adaptation.

Still another object of the present invention is to further specify the signal processing devices, which were described only generally in the aforesaid published application.

These objects are attained in that the tube is accommodated in or consists of a housing that is externally shaped like a conventional cylinder or insert and has at least two adjacent cylindrical chambers with their axes paralleling that of the weapon's barrel, whereby each chamber accommodates a tube, a diode, or a system of batteries and is demarcated at one end by a plate that is accommodated in another chamber and has the electronic circuitry for the transmitter mounted on it and whereby the three chambers constitute mutually displaced spaces enclosed in the one-piece housing.

These measures make it possible to emit pulses of infrared light activated by the hammer from the mouth of either a revolver or a pistol that allow various types of electronic processing on the part of the receiver. The particular design of the cylinder or insert allows extensive flexibility with respect to the type of side arm while being relatively simple in design and easy to manufacture.

The subsidiary claims recite practical advanced embodiments of both the mechanical components and of the circuitry involved in the transmitter and receiver, the latter pursuant to the only generalized embodiment described in the aforesaid published application deriving from the same applicant.

BRIEF DESCRIPTION OF THE INVENTION

Figure 1:
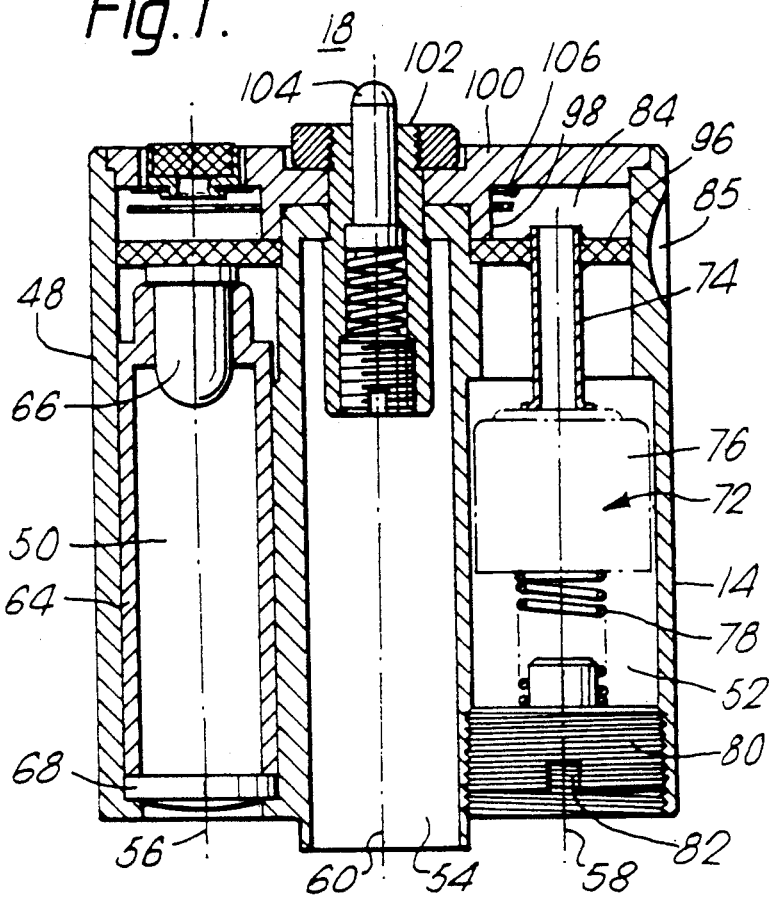
Figure 2:
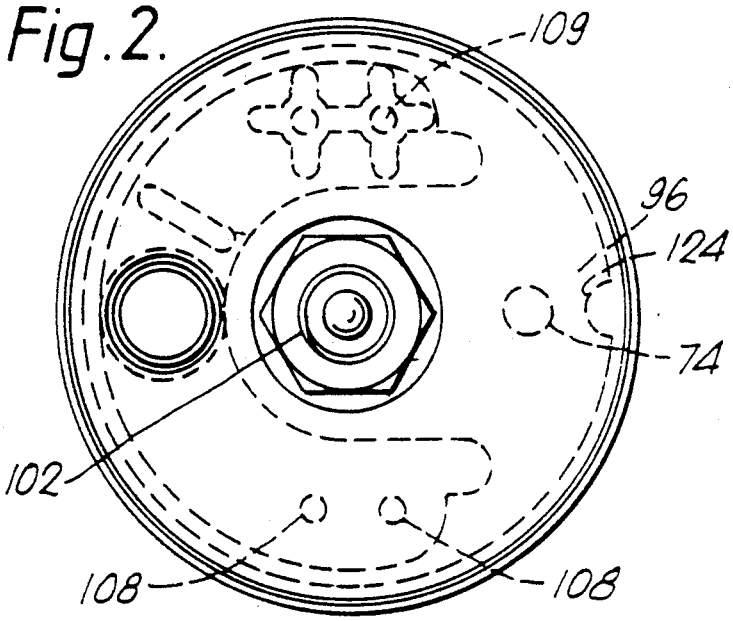
Figure 3:
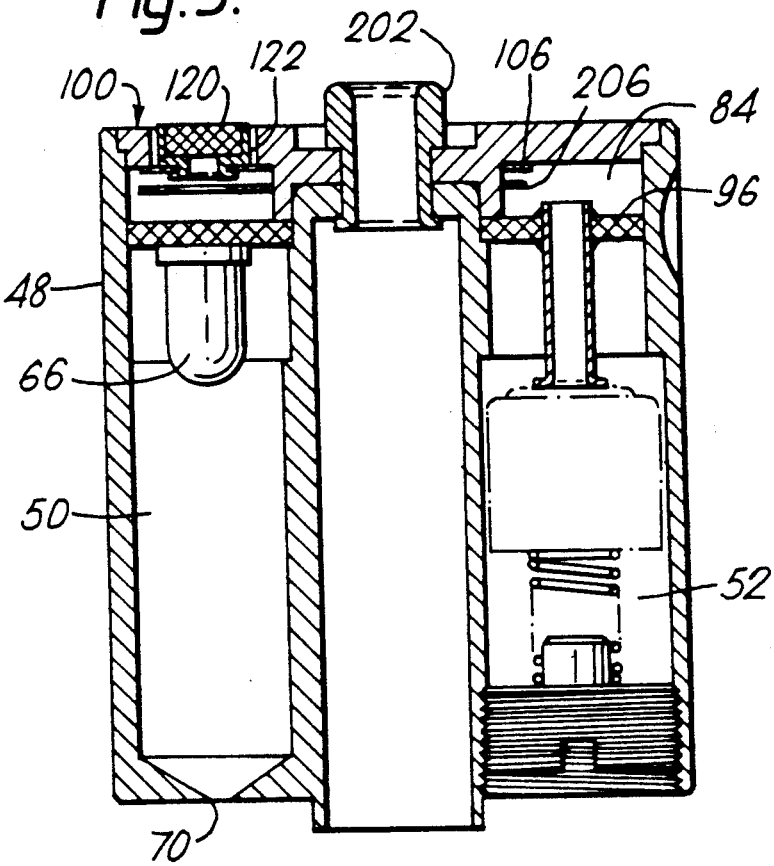
Figure 4:
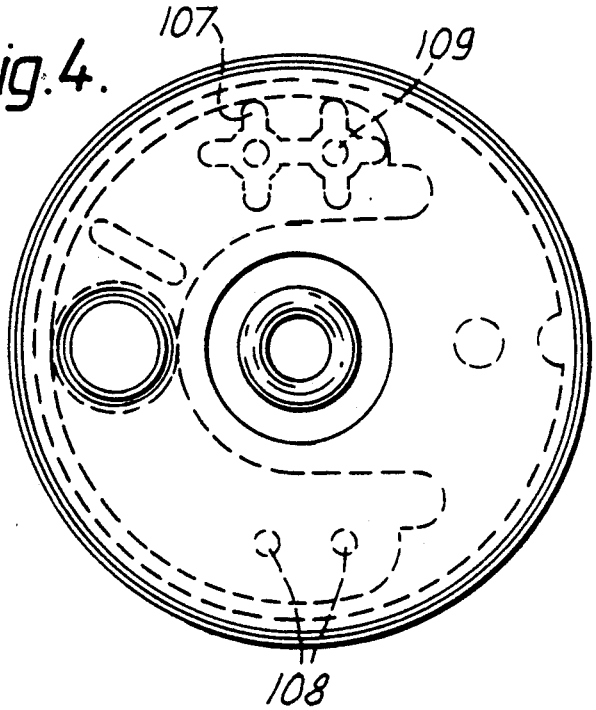
Figure 5:
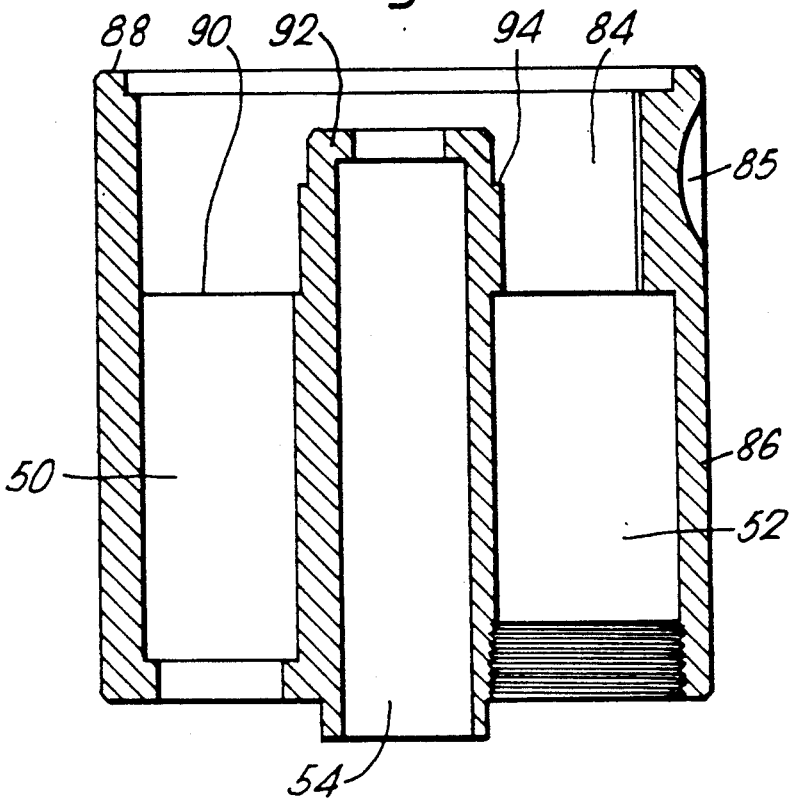
Figure 6:
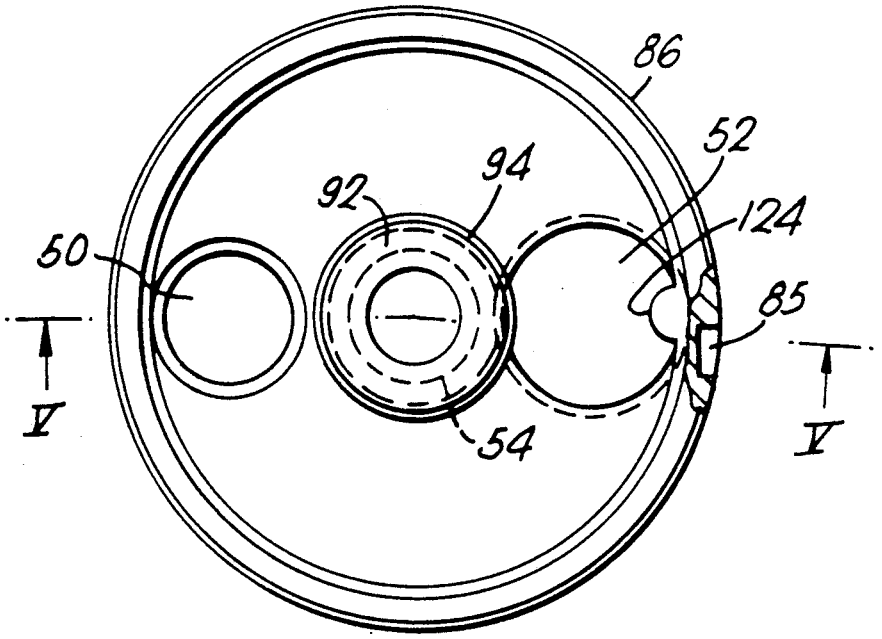
Figure 7:
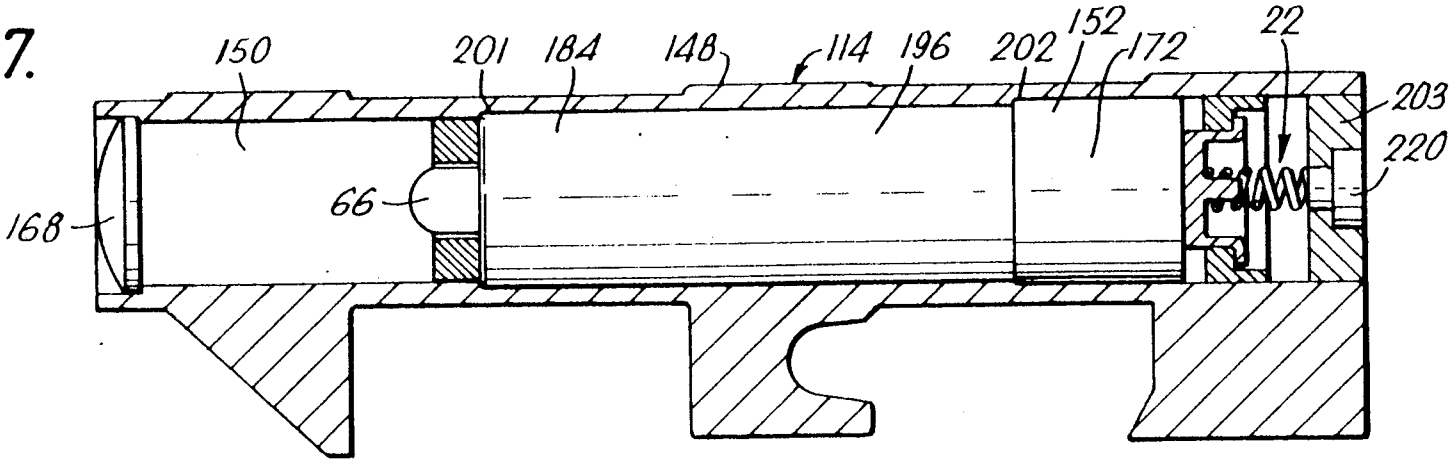
Figure 8:
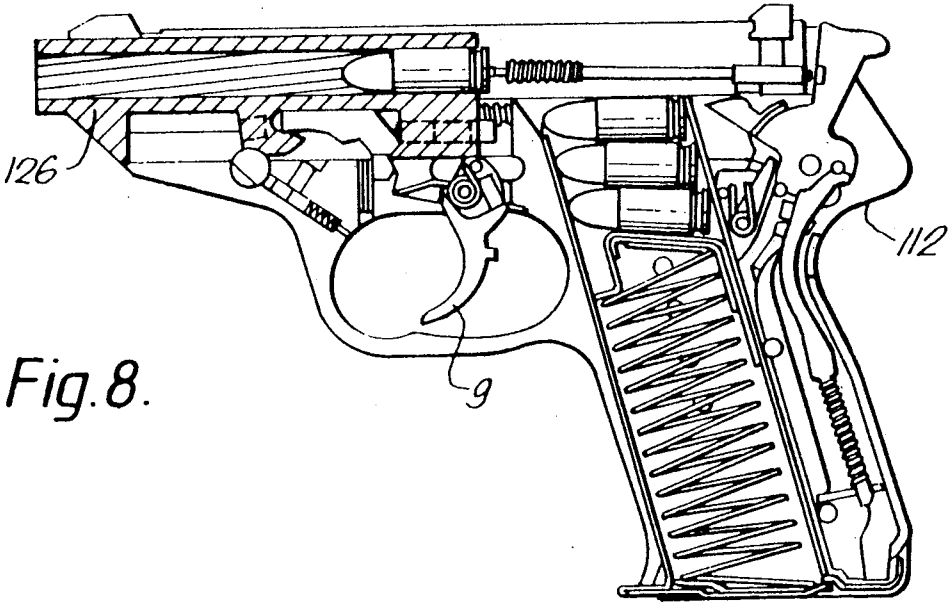
Figure 9:
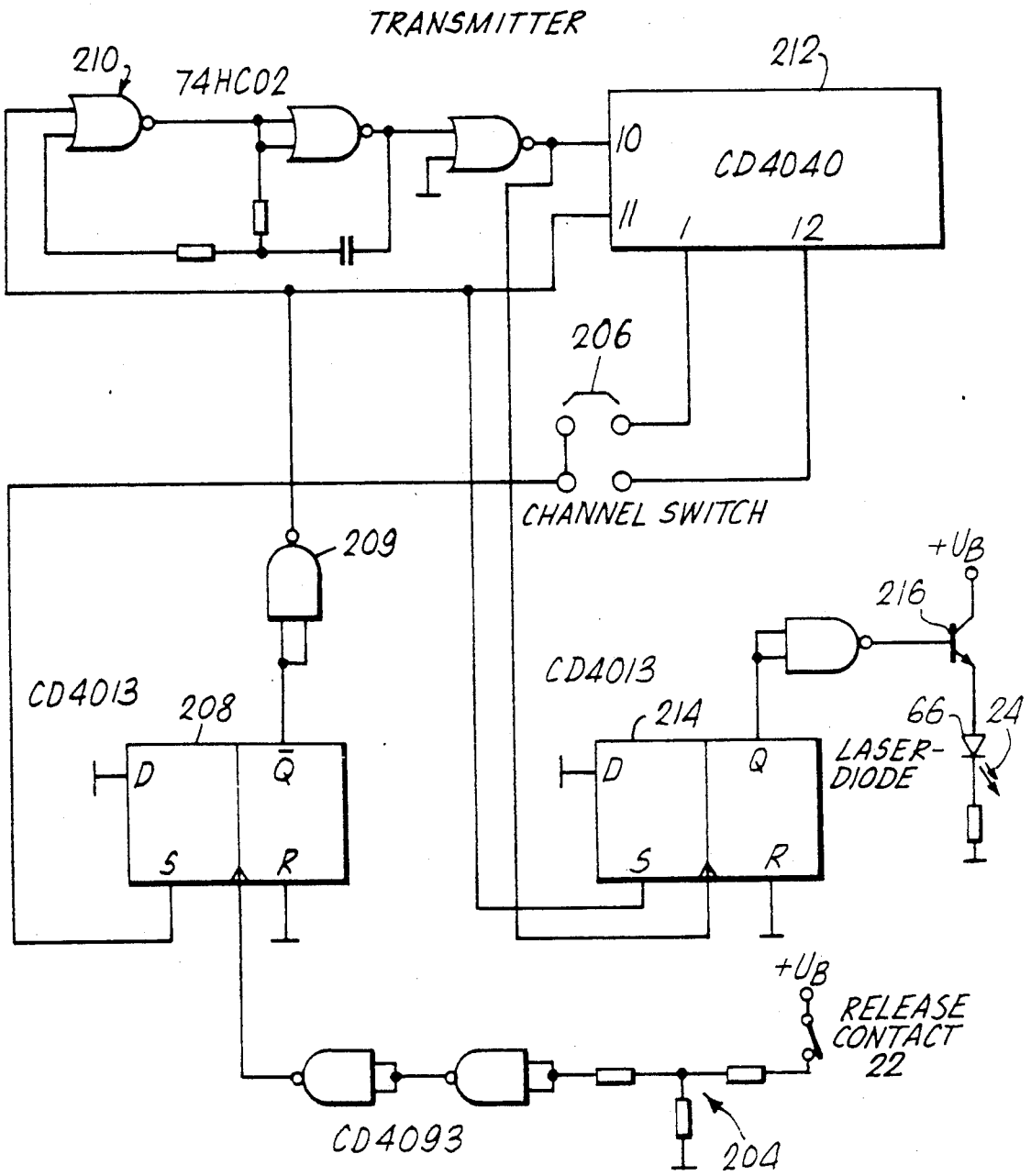
Figure 10:
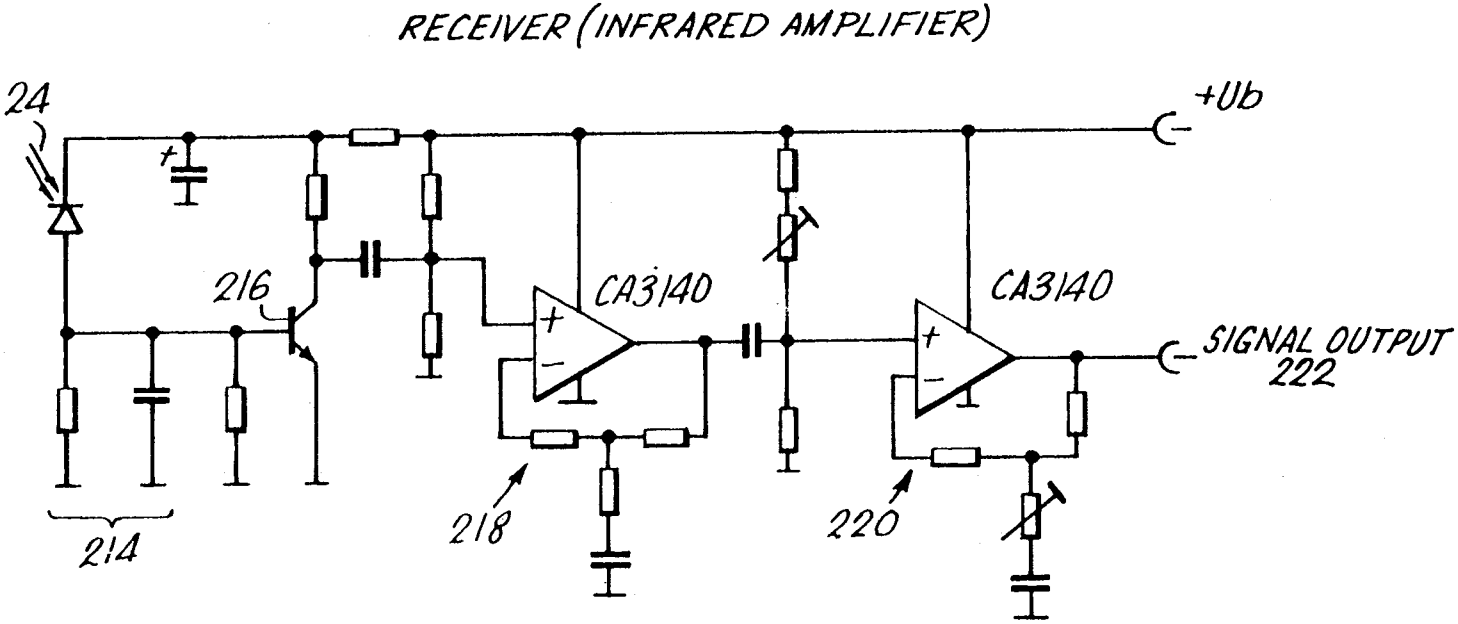
Figure 12:
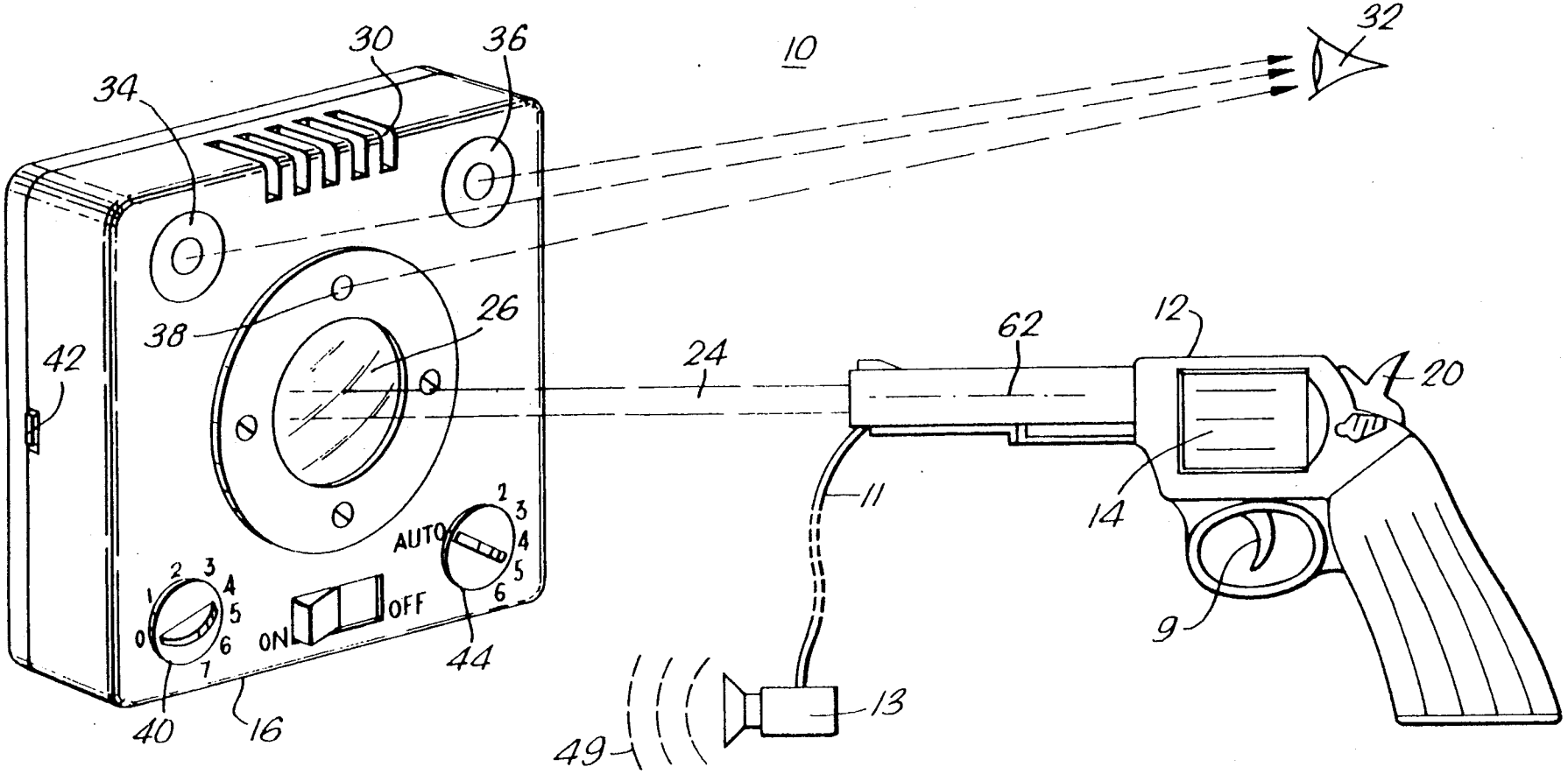

Embodiments of the invention will now be described with reference to the drawings, wherein FIG. 1 is an axial section through an embodiment of a cylinder intended for use with a revolver (a Smith & Wesson 357-caliber in the present case) and including a transmitter for infrared light, FIG. 2 is a top view of the cylinder illustrated in FIG. 1, FIG. 3 illustrates a slightly different version of the cylinder illustrated in FIGS. 1 and 2 and appropriate for a different make of revolver, FIG. 4 is a top view of the cylinder illustrated in FIG. 3, FIG. 5 is an axial section through the housing of another embodiment, FIG. 6 is a top view of the housing illustrated in FIG. 5, FIG. 7 is an axial section through an insert in accordance with the invention and appropriate for use with a pistol, FIG. 8 is a section through a pistol (a Walther P5 in this case) with a barrel that can be replaced by the insert illustrated in FIG. 7, FIG. 9 is a schematic representation of the circuitry of the transmitter that is accommodated in the cylinder or insert and generates a coded beam of infrared light, FIG. 10 is a schematic representation of the electronic circuitry in the first section of the receiver and appropriate for amplifying the infrared light, FIG. 11 is another section of the receiver that contains the electronic controls downstream of the infrared amplifier, FIG. 12 illustrates how the training aid works, and FIG. 13*a–g* comprises various illustrations of the circuits in the integrated modules.

Initial reference is made to FIG. 12, which is an overall view of a training aid 10 for side arms, a revolver 12 for example, that consists of a transmitter in the form of a cylinder 14 (for a revolver 12) or of an insert 114 (for a pistol 112, cf. FIG. 8) and of a receiver 16 in the form of a preferably battery-operated box that can be positioned at any point as illustrated in the figure. When the weapon's hammer 20 strikes a contact 22 that is electrically connected to a transmitter 18, the circuitry of which is illustrated in FIG. 9, the transmitter emits a brief and narrowly collimated beam 24 of infrared light with a range of 25 m for example. Receiver 16 is located at that range. If beam 24 strikes a lens 26 with a receiving diode 28 (FIG. 10) positioned behind it, the receiver circuitry illustrated in FIG. 10 produces a "hit" signal, in the form of a beep from a loudspeaker 30 for example or in that of visual signals from one or two light-emitting diodes 34 and 36 within range of the marksman's eye 32 and labeled. Beam 24 is modulated to prevent interference from daylight and other sources, and practice can be carried out in either bright light or in the dark. The training commences with a point of light, red for example, generated by a light-emitting diode 38, appearing at box-shaped receiver 16 for a brief period of time, during which the weapon must be fired. The marksman can adjust the level of difficulty with manual controls 40 that vary the duration of the period from 1 to 8 seconds for example, within which time the shot must be fired once readiness signal 38 has lit up, and must strike the target, lens 26. Hits are indicated by the illumination of a green signal, for example diode 34, and by an audible signal from loudspeaker 30, which can be turned off with a switch 42. After a brief pause, the duration of which can be adjusted by manual controls 44, lens 26 is ready to be hit again. The lengths of the pauses can alternatively be varied with an integrated randomness generator 46 (by setting manual controls 44 at "auto"), in which case readiness signal 38 will light up at unpredictable intervals, simulating actual combat conditions.

If an infrared laser with a wavelength of 800 nm is employed instead of an infrared-light emitting diode, the range can be increased more than twice (e.g. to 50 m), to more or less correspond to the conditions encountered in competitive shooting with side arms. Doing so will also simulate the narrower spread that is characteristic of such weapons, meaning that the marksman must aim more carefully in order to hit the target.

THE BEST EMBODIMENT OF THE INVENTION

FIGS. 1 through 6 illustrate in greater detail how the transmitter 18 accommodated in revolver 12 for example is constructed. As will be evident from FIG. 1, which is an axial section, the transmitter consists of a housing 48 that is externally shaped like the cylinder conventionally employed in a revolver 12. The housing 48 in the illustrated embodiment has three adjacent cylindrical chambers 50, 54, and 52 with their axes 56, 58, and 60 paralleling the axis 62 of the weapon's barrel. Chamber 50 accommodates a tube 64, one end of which surrounds a diode or laser diode 66 and the other end of which surrounds a lens 68 or other focusing device. The tube 68 has been left out of the embodiment illustrated in FIG. 3, and diode 66 is directly accommodated in cylindrical chamber 50, whereby the focusing device is a round aperture 70. Chamber 52 accommodates a battery system 72 consisting of a round cell 76 that rests against a rivet 74 and secured in place at the other end by a spring 78. Spring 78 is itself retained in position by a lid-like screw 80 that closes off chamber 52 and has a slot 82. The screw is also employed to reduce the tension.

Cylinder 14 rests in a recess 84 inside the revolver in a position in which the axis 56 of chamber 50 coincides with the axis 62 of the revolver's barrel, with focusing device 68 also in alignment with the weapon's mouth.

The end of cylindrical chamber 50 that faces away from the mouth of the weapon and accommodates diode 66 is demarcated by a plate 84 that contains the transmitter's electronic circuitry. Plate 84 is accommodated in another chamber in cylinder 14 as illustrated in particular in FIGS. 5 and 6. From these figures it will be evident that the chambers 50, 52, and 84 that accommodate the optical system, battery, and electronic circuitry are definitely mutually displaced and surrounded by a one-piece main housing 86. Main housing 86 is, as will be especially evident from FIG. 6, in particular either a solid blank with the cylindrical chambers machined out of it or a metal casting with chambers 50 and 52 mutually displaced 180° in relation to the axis 60 of the round body of main housing 86.

Third chamber 84 is cylindrical at the top and annular at the bottom, extending inward from the face 88 of round body 86, with the other two cylindrical chambers 50 and 52 extending from its bottom surface 90.

The annular section of chamber 84 is demarcated by a cup-shaped component 92 that extends into it and closes off the chamber 54 that includes the axis of the cylinder. The cup-shaped component also creates an annular shoulder 94, against which rests one interior edge, and the circular perforation inside it, of plate 96, which is annular in this embodiment. The other side of the annular shoulder is secured in position by an annular projection 98 that extends out of a housing lid 100. The lid, which is made of an insulating material, closes off chamber 84 and is secured in position by a hollow threaded bolt 102 in the embodiment illustrated and by a hollow rivet 202 in the embodiment illustrated in FIG. 3. Hollow bolt 102 and hollow rivet 202 also adapt the device to different types of weapon. Accommodated in the hollow threaded bolt 102 illustrated in FIG. 1 for example is a resilient bolt 104, whereas a similar resilient bolt on the weapon can engage the recess created by the hollow bolt or the hollow rivet 202 illustrated in FIG. 3.

Riveted to plastic lid 100 is a sickle-shaped leaf spring 106 (cf. the riveting point 108 in FIGS. 2 and 4), and another identical spring 206 is mirror-symmetrically riveted to the opposite side of the lid at riveting point 109. The stamped-out crosses 107 evident in the figure separate the two springs when they are tensioned. At the center of sickle-shaped leaf spring 106 is a firing pin 120 that extends through a matching bore 122 in lid 100, such that it can be struck by the revolver's hammer and travel against the force of leaf spring 106 toward spring 206 and come into electrical contact with it. Springs 106 and 206 are electrically connected to switching points on plate 96 in order to release pulses of light.

To ensure correct alignment of plate 96 when it is mounted, main housing 86 has an alignment projection 124. Cylindrical or annular chamber 84 is large enough to accommodate not only plate 96 but also part of diode 66 and the supporting rivet 74 that secures the battery as well as the electronic circuitry that will be described hereinafter with reference to FIG. 9.

FIG. 8 illustrates a pistol. Pistols of course have a replaceable barrel instead of a replaceable cylinder. The original barrel 126 in the illustrated example is replaced with the replacement insert 114 illustrated in FIG. 7, which has the same external shape. The insert also has a release that can be activated by the weapon's hammer, embodied in the present case by a firing pin 220 that in turn activates a transmitter mounted on a plate 196 and associated with a laser diode 66 that emits infrared light and is supplied with power from a battery system 172. Insert 114 has a housing with a cylindrical chamber 150 for an optical system consisting of an infrared-laser diode 66 and of a focusing device, a lens 168 for example, another adjacent cylindrical chamber 184 that accommodates a plate 196 with the transmitter circuitry, and a third adjacent cylindrical chamber 152 that accommodates a battery system 172 and a release and contact 22. In this case as well, the axes of the individual chambers parallel and are actually in alignment with the axis of the weapon's barrel. The metal housing is preferably diecast. The individual chambers 150, 184 and 152 are in axial alignment, with progressively shorter diameters, and mutually displaced. The displacements constitute annular shoulders 201 and 202 that support both plate system 196 and battery system 172 with its release-and-contact system 72. This feature facilitates assembly of the various components. Cylindrical chamber 152, which also accommodates the battery, is closed off by a plug 203 that covers the end of the chamber and also accommodates the aforesaid release 220.

The plate 196 and its associated chamber 184 in this embodiment as well are large enough to accommodate the individual elements of the circuitry as illustrated in FIG. 9.

The transmitter circuitry mounted on plate 96 or 186 will now be described in greater detail with reference to FIG. 9. One contact of release 22 is connected to one pole of the battery (+UB, with the other connected to mass) and the other contact to a chain 204 of resistors, to a series of CD4093 inverters, and to one half of a CD4013 integrated module, specifically to its timing terminal. A RESET terminal R and a DATA terminal D are connected to mass. A SET terminal S can be connected as desired by way of a channel switch 206 to the terminal 1 or the terminal 12 of another integrated module in the form of an asynchronous twelve-stage binary counter. These modules are commercially available, and their circuitry is illustrated only for the sake of completeness in FIG. 13 *a* and *b*.

Integrated module CD4093 is a combination of four NAND Schmitt triggers, each with two input terminals and is also commercially available.

Other types with similar properties can of course also be employed.

The $\overline{Q}$ output from flip-flop 208 is forwarded by way of another NAND stage 209 (part of integrated module CD4093) to the contact 11 of integrated module CD4040 (reset input terminal), by way of a delay circuit 210 to the terminal 10 (the timing input terminal) of integrated module CD4040 (reference number 212), and to the S input terminal (the setting input terminal) of the other D flop-flop in integrated module CD4013. Its trigger input terminal is also connected to the output terminal of circuit 210, whereas the R and D input terminals are grounded. The Q output terminal of this flip-flop is also connected by way of a NAND Schmitt trigger (part of CD4093) to a drive transistor 216 that connects laser diode 66 to batter power. Circuit 210 consists of a series of NOR stages, which can also be in the form of an integrated module, a 74 HC 02 for example, which contains four NOR stages.

FIG. 10 illustrates the infrared-signal amplifier accommodated in the housing of the receiver 16 illustrated in FIG. 12, wherein a light-sensitive diode 28 is positioned behind and at the focal point of lens 26. Infrared-light signal 24, which enters at a particular pulse-repetition frequency, to which an oscillating circuit 214 consisting of an L stage and a C stage can be adjusted, is forwarded to the base of a transistor 216, the collector of which is activated by a series of two operational amplifiers 218 and 220 to ensure a strong enough signal at an output terminal 222. Although the operational amplifiers in the present embodiment are CA3140's, other similar types can also be employed.

FIG. 11 illustrates the details of the electronic controls downstream of the infrared amplifier illustrated in FIG. 10. The output signal from the terminal 222 illustrated in FIG. 10 is in this case forwarded to the input terminal 224 illustrated in FIG. 11. After traveling through a NOR stage 226, the signal arrives in a decoding circuit, wherein the different pulse frequencies (established e.g. by the channel switch 206 illustrated in FIG. 9) are decoded by an asynchronous twelve-stage binary counter 228, in this case a commercially available CD4040 integrated module, which can also be employed in the transmitter. The reception signal controls its timing input terminal 10, whereas resetting occurs by way of input terminal 11 by another module 230 in the form of a monostable multivibrator triggered by way of trigger input terminals 8 and 12 and providing a resetting signal at its output terminal 11. The signals supplied at the output terminals 12 and 14 of module 228 are supplied to the chain of two connecting stages 232 and 234 and then to a D flip-flop, which activates, by way of another connecting stage 238, a driver transistor and hence a light-emitting diode 34 that signals a hit. The output terminal from module 228 is also forwarded to another D flip-flop 240 with a Q output terminal that activates, by way of a connecting stage 242 and a transistorized driver stage, another diode 36 that signals another hit.

D flip-flops 236 and 240 are again integrated modules as in the transmitter circuitry.

A loudspeaker 30 can also be activated by way of another connecting stage 244 and of a driver amplifier with volume controls. The output from flip-flop 240 is forwarded along with the output from integrated module 23 to another connecting stage 246 that leads to the resetting input terminal of another monostable multivibrator (here in the form of a CD4047). This module 248 is responsible for the readiness signal. It is triggered by way of trigger input terminal 8 by an integrated module 250, which is a decimal counter with ten decoded outputs in the form of a CD4017. This module controls the timing. The output from module 248, terminal 10, is connected to the based of the driver transistor that activates readiness diode 38 and the signal is simultaneously forwarded to the trigger input terminal of a D flip-flop 252, the $\overline{Q}$ output of which is forwarded in the capacity of a control signal to connecting stage 244 and by way of another connecting stage 254 to the resetting input terminal 15 of module 250 and in the capacity of a control pulse and by way of still another connecting stage 256 to still another integrated module 258 (a 4521) that generates a clock pulse governing the sequence of events. This clock pulse is forwarded to the clock input terminal 14 of module 250 and activates by way of terminal 11 another module 260 (a 40192) that governs the non-receiving intervals. This component is a back-and-forth BCD decimal counter that activates, by way of output terminal 13, the resetting terminal of a D flip-flop 262, the trigger input terminal of which is activated by overall-control module 250 and terminal 4 (Q2). Its Q output is also at the input terminal 13 of this module, the negated clock-frequency input terminal, that is, by way of which a clocking signal can then be received from input terminal 14. The output from terminal 7, corresponding to Q3, is simultaneously forwarded to module 248 and specifically to its trigger input terminal 8. The terminal 2 of module 250, its Q1 output terminal, that is, is connected to the output terminal 11 of module 260 and to the resetting input terminals of D flip-flop 236. The switch 44 discussed with reference to FIG. 12 can be employed to vary the length of the pause in that an appropriate binary switch activates, by way of a connecting stage, the DATA input terminal of flip-flop 262 and the terminal 9 of a CD40160 CMOS (counter) 264, which acts in the capacity of a randomness generator, generating pauses of an unpredictable length.

Figure 13D:
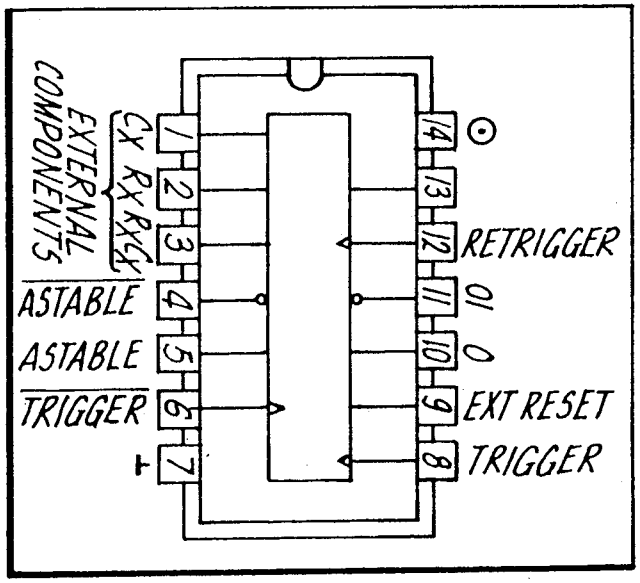

Reference is now made for the purpose of a better overall view to FIG. 13*c*, which illustrates the circuitry of a 4017 integrated module (a decimal counter synchronized with ten decoded outputs), and to FIG. 13*d*, which illustrates a 4047 module, a monostable-astable multivibrator.

Figure 13E:
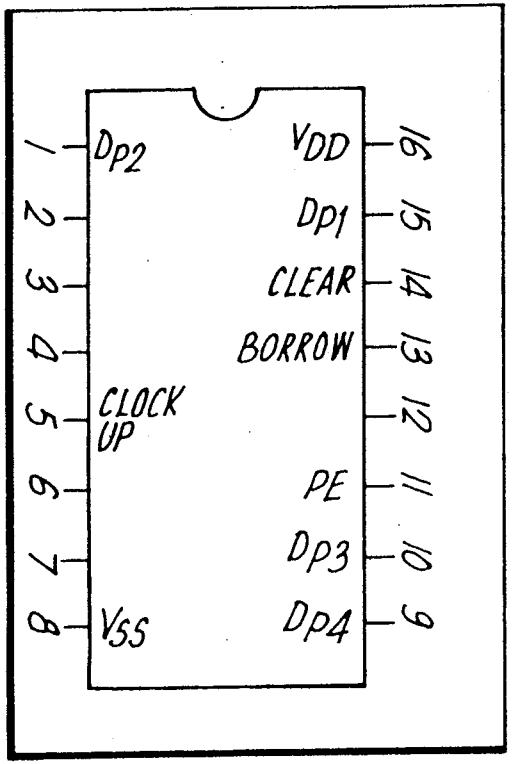
Figure 13F:
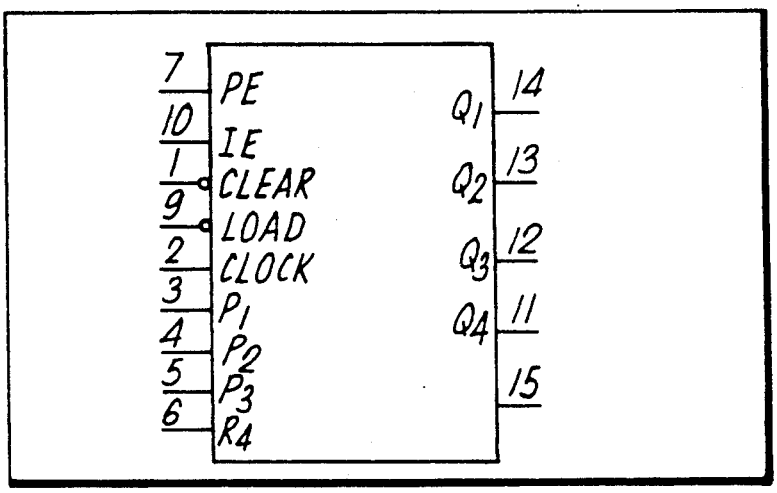
Figure 13G:
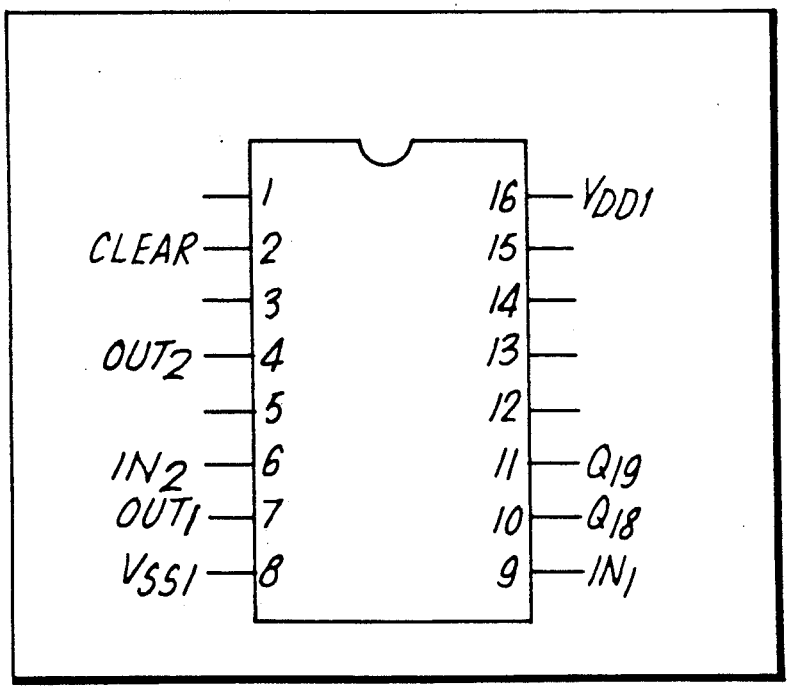

FIGS. 13*e* and *f* illustrate 40192 and 40160 modules. The 40160 is a synchronous programmable 4-bit (decadic) counter with asynchronous extinction, and the 40192 is a synchronous 4-bit back-and-forth counter (dual-frequency with resetting). FIG. 13*g* illustrates the 4521, a 24-stage frequency divider.

What is claimed is:

1. In a training aid (10) for such side arms as revolvers and pistols that have a barrel and hammer and comprise a transmitter (18) in the form of a replaceable cylinder (14, when the weapon is a revolver) or of a replaceable insert (114, when the weapon is a pistol or similar piece) and a receiver (16), wherein the transmitter has a release (22) that is activated by the impact of the weapon's hammer (20) and causes the transmitter to emit simultaneously with the impact a brief and narrowly collimated beam (24) of infrared light, the receiver is positioned at a desired distance away and produces a signal when it receives the beam, the beam of infrared light is generated by a diode (66) accommodated in a tube, and the release is at one end of the tube and means (68, 70, or 168) that focuses the beam is at the other end, the improvement wherein the tube is accommodated in or consists of a housing (48 or 148) that is externally shaped like a conventional cylinder or insert and has at least two adjacent cylindrical chambers (50 & 52 or 150 & 172) with their axes (56 and 58) paralleling that (62) of the weapon's barrel, wherein each chamber accommodates a tube (64), a diode, or a system of batteries (72 & 172) and is demarcated at one end by a plate (96 or 196) that is accommodated in another chamber (84 or 184) and has electronic circuitry (FIG. 9) for the transmitter mounted on it and wherein the three chambers constitute mutually displaced spaces enclosed in the one-piece housing (49 or 148).

2. Training aid as in claim 1, characterized in that the infrared diode (66) is an infrared-laser diode.

3. Training aid as in claim 1, wherein the housing (148) is a replaceable insert (114) for a pistol (112), having three chambers (150, 184, & 152) which are cylindrical and axially aligned, the chambers being mutually displaced by discontinuously increasing diameters and the housing (148) is diecast from metal.

4. Training aid as in claim 3, characterized in that the chamber (150) with the shortest diameter accommodates an optical system, which consists of a diode (66) and focusing device (168), in that the chamber (184) behind it and having the mid-length diameter accommodates a plate (196), and the subsequent chamber (172) with the longest diameter accommodates a battery system (172).

5. Training aid as in claim 4, characterized in that the chamber (152) for the battery system (172) is closed off with a plug (203) inserted into the end of the chamber and in that the release (220) is mounted on a plug.

6. Training aid as in claim 1, wherein the housing (48) is a replacement cylinder (14) for a revolver, characterized in that the two cylindrical chambers (50 and 52) are two bores accommodated in a body that consists of a solid round piece of metal and are displaced approximately 180° around the axis (60) of the body and in that the other chamber (84) consists of a depression that has a bottom (90) and deviates inward from the face (88) of the round metal body (86).

7. Training aid as in claim 6, characterized in that a sickle-shaped projection (92) projects into the other chamber and has an annular shoulder (94) around it, against which a circular disk-shaped plate (96) rests on one circular inner edge, and the other circular inner edge is secured in position by an annular projection (98) that rests on a housing lid (100) covering another chamber (84).

8. Training aid as in claim 7, characterized in that the annular projection (98) constitutes a supporting surface for the housing lid (100) and the cup-shaped part and the housing lid are screwed (102) or riveted (202) together.

9. Training aid as in claim 8, characterized in that the parts are screwed or riveted together with a hollow bolt (102) or hollow rivet (202), whereby a pin that snaps into the revolver or extends out of it comes to rest inside the bolt or rivet.

10. Training aid as in claim 7, characterized in that the housing lid (100) consists of insulating material and has a sickle-shaped leaf spring (106) that is secured at the end (108) to the housing and spring (206) isolated at a slight distance away and (109) secured to the housing lid that is mechanically connected to a firing pin (120) accommodated in a perforation (122) through the lid.

11. Training aid as in claim 1, characterized in that the replacement cylinder (14) weighs approximately as much as the conventional cylinder used with that revolver when full of cartridges.

12. Training aid as in claim 1, characterized in that the battery system (72) includes a metal projection (74), a tubular rivet for example, that rests on the plate (96) and acts as a support for one face of a battery (76), the other end of the battery rests against a compression spring (78) that is secured in position by a lid (80), preferably in the form of a screw with a thread that extends around a head with a slot (82), that closes off the cylindrical chamber (52).

13. Training aid as in claim 1, characterized in that the transmitter (18) has the following structure:

(a) One contact of the release (22) is connected to operating voltage (+UB) and the other contact of the release is connected by way of a chain (204) of resistors and pulse-shaping connecting stages to the clocking terminal of a D flip-flop.

(b) The output ($\overline{Q}$) from the D flip-flop is connected, optionally by way of a pulse-shaping or polarity-inverting connecting stage (20), to the setting terminal (S) of another D flip-flop (214), the output (Q) from which is connected, optionally by way of pulse-shaping or polarity-inverting connecting stage, to the gate of a driver transistor (216), that connects the laser diode (66) to operating voltage (UB).

(c) The clocking input terminal of the second D flip-flop (214) is also connected by way of a chain circuit comprising further connecting stages and including RC stages to the output terminal of the first flip-flop.

14. Training aid as in claim 13, characterized by a multistage asynchronous binary counter, especially a twelve-stage binary counter (212), the clocking input terminal (terminal 10) of which is activated by the output signal from the connecting-stage circuit (210) and the resetting input terminal (terminal 11) of which is activated by the output ($\overline{Q}$209) from the first D flip-flop (208), and which is connected from the two or more binary-stage output terminals (e.g Q12, terminal 1, and Q8, terminal 12) by way of a plug-in channel switch (206) with the setting terminal (S) of the first D flip-flop (208), making it possible to select two (or more) different numbers of light pulses for each release procedure.

15. Training aid as in claim 1, characterized in that the receiver (16) has the following structure:

(a) One terminal of the receiving diode (28) is at an LC stage (214) that can be tuned to a prescribed modulation frequency and at the base of a transistor (216).

(b) The collector or output terminal of the transistor circuit (216) controls the series switching of two operations amplifiers (218 and 220), generating an amplified output signal at a signal output terminal (222) that is connected to the input terminal (224) of electronic controls (FIG. 11) for the receiver (16).

16. Training aid as in claim 15, characterized in that the electronic controls (FIG. 11) contain decoders (228 & 230) that identify the beam of light from the transmitter (18), wherein the decoder comprises an asynchronous, multistage binary counter, especially a twelve-stage binary counter (228), the clocking input terminal (terminal 10) of which is supplied with the input signal by way of a connecting stage (226) and the resetting terminal (11) of which is activated by a monostable or astable multivibrator (230) that is likewise triggered by the input signal (terminal 8) and forwards another input in the form of an external resetting signal to the connecting stage (226), which is supplied with the input signal, whereby the first output (Q8, terminal 12) and another output (10, terminal 14) from corresponding stages in the binary counter are forwarded by way of further connecting stages (232 and 234) to the clocking input terminal of a D flip-flop (236) and directly to the clocking input terminal of another D flip-flop (240), the outputs (Q and $\overline{Q}$) of which activate, by way of further connecting stages (238, 242, and 244) and their associated driver transistors, light-emitting diodes (34 & 36) or audio equipment (30).

17. Training aid as in claim 16, characterized in that another input of the connecting stages (238, 242, and 242) is supplied to activate the signal devices (34, 36, and 30) by one output ($\overline{Q}$) from a third D flip-flop (252), the clocking input terminal of which is connected to the output (Q, terminal 10) of a monostable-astable multivibrator (248), said output constituting a readiness signal that is also forwarded by way of a transistorized driver to another signal diode (38), said flip-flop (248) being activated by way of a connecting stage (246) by the output from the second D flip-flop (240) and by the output from the multivibrator (230), and the trigger input terminal (terminal 8) of which is activated at one output (output Q3, inlet 7) of a decimal counter (240) with preferably ten decoded outputs, and the output ($\overline{Q}$, terminal 11) of which is supplied in the form of another terminal to the connecting stage of the decoder and to the resetting terminal of the associated multivibrator (230).

18. Training aid as in claim 17, characterized in that the clocking input terminal (terminal 14) of the decimal counter (250) is connected to the output from a clock-generating module (258), its resetting input terminal (terminal 15) by way of a connecting stage (254) to the output ($\overline{Q}$) of the D flip-flop (252, for readiness), and its clock-activating input terminal (terminal 13) to another D flip-flop (262), the clocking input terminal of which is connected to another output (Q2, terminal 4) of the decimal counter (250), the data input terminal (D) of which is activated by way of another connecting stage by a binary pause-adjustment switch (44), the resetting input terminal (44) of which is activated by the output (terminal 13) from a pause-timing generator (260).

19. Training aid as in claim 18, characterized in that the module (260) that generates the pause timing is connected to another output (Q1, terminal 2) from the binary counter (250) and to the resetting terminals of the D flip-flops (236 and 240), which act as signal memories.

20. Training aid as in claim 19, characterized in that the pause-timing generator (260) is connected to another module (264), which is in turn connected to a random-number generator and to the manually adjustable binary-switch input signals (44), whereby the pause times can be established manually or by the randomness generator and according unpredictably.

* * * * *